US005944411A

United States Patent [19]

Holten et al.

[11] Patent Number: 5,944,411

[45] **Date of Patent: *Aug. 31, 1999**

[54] LUMINAIRE SLAT WITH V-SHAPED CROSS SECTION

[75] Inventors: Petrus A. J. Holten, Winterswijk, Netherlands; Corinne Lac, Nevers, France

[73] Assignee: U.S. Philips Corporation, New York, N.Y.

[ * ] Notice: This patent is subject to a terminal disclaimer.

[21] Appl. No.: 08/940,758

[22] Filed: Sep. 30, 1997

[30] Foreign Application Priority Data

Oct. 8, 1996 [EP] European Pat. Off. ..... 96202794

[51] Int. Cl.[6] ..... F21V 7/00

[52] U.S. Cl. ..... 362/342; 362/290; 362/291

[58] Field of Search ..... 362/290, 291, 362/342, 303, 346, 297, 147, 343

[56] References Cited

U.S. PATENT DOCUMENTS 4,888,668 12/1989 Roll .
5,528,478 6/1996 Degelmann ..... 362/290
5,758,954 2/1996 Holten ..... 362/291

FOREIGN PATENT DOCUMENTS

0122972A1 10/1984 European Pat. Off. .
3215026A1 3/1984 Germany .
A9402049 7/1996 Netherlands .
9625623 8/1996 WIPO .

*Primary Examiner*—Sandra O'Shea
*Assistant Examiner*—Marshall Honeyman
*Attorney, Agent, or Firm*—F. Brice Faller

[57] ABSTRACT

The luminaire for a tubular electric lamp (3) has, in a housing (1) with a light emission window (2) in plane P, reflectors (5) at either side of the lamp (3) and a number of slats (10) transverse to the reflectors (5) below the lamp (3). The slats (10) are V-shaped in cross-section and have an inner surface (11) facing the lamp (3). The inner surface (11) has a central zone (12) and flanks (13) which extend at an angle away from plane P. The inner surface (11) has end zones (14) near the reflectors (5) which are in a plane Q parallel to plane P. The longitudinal axis (4) of the lamp (3) is situated in a region extending from plane Q towards plane P. Although the slats are relatively small, bright spots within the shielding angle of the luminaire are avoided.

5 Claims, 3 Drawing Sheets

LUMINAIRE SLAT WITH V-SHAPED CROSS SECTION

BACKGROUND OF THE INVENTION

The invention relates to a luminaire comprising:

a housing with a light emission window in a plane P;

a tubular electric lamp having a longitudinal axis, in the housing;

concave reflectors which extend to inside the light emission window, laterally of the lamp in the housing, which reflectors are curved, while the lamp is positioned between the reflectors so as to throw light radiated transversely to the longitudinal axis through the light emission window to the exterior at an angle to plane P greater than a cut-off angle β;

a plurality of concavely curved slats which are V-shaped in cross-section, which extend transversely to the reflectors, which extend to inside the light emission window, and which each have between the reflectors a reflecting inner surface facing the lamp, which inner surface has flanks which extend from a central zone, centrally between the reflectors, at an angle away from the plane P.

Such a luminaire is known from WO-A-96/25 623 to which U.S. Pat. No. 5,758,954 corresponds.

The slats of the known luminaire each have a reflecting inner surface which is to prevent that much light, for example approximately 10%, is intercepted by the slats and is largely lost in the slats, as would be the case if the slats were open, or is absorbed as would be the case if the slats had a light-absorbing inner surface The inner surface of each slat extends from a zone centrally between the reflectors along its flanks at an angle upwards up to the reflectors in order to prevent undesirable reflections. It is in fact known from EP-A-0 122 972 that, if a light beam hits the inner surface just before it would reach a reflector in the case of slats having reflecting, for example mirroring inner surfaces parallel to plane P, this light beam would be reflected by the inner surface in such a direction that very bright spots are visible from the cut-off angle. Although the reflectors are only designed to throw light coming from above, directly from the lamp, to the exterior outside the cut-off angle β, the light reflected on the inner surface reaches the reflector from below. The inner surface and the reflector together can accordingly display very bright images of longitudinal portions of the lamp within angle β which constitute glare.

The fact that the inner surface rises towards the reflectors in its flanks outside a central zone achieves that the inner surface reflects the incident light to locations higher up in the housing which are designed for dealing with light which comes to a greater or lesser extent from below. The light reflected by the inner surface is as a result utilized after a subsequent reflection and added to the light beam formed by the luminaire.

The slats extend to above the lamp in the luminaire according to the cited EP-A-0 122 972. The zone of the inner surface positioned centrally between the reflectors in this luminaire may be straight and parallel to plane P, or cylindrical and parallel to the lamp. The inner surface of each slat in this luminaire has lateral edges which extend transversely to the longitudinal axis of the lamp and which are mutually parallel.

The slats also extend to above the lamp in the luminaire known from DE-A-32 15 026. The inner surface of each slat is substantially closed and reflecting. The lateral edges of the inner surface, however, approach one another in a direction from the central zone towards the reflectors.

This is also the case in the luminaire known from US-A-4,888,668. The lateral edges of the inner surface, however, here approach one another so strongly that they already reach one another in a point of intersection at a distance from the reflectors. The upper side of the slat extends from the point of intersection parallel to plane P towards the reflectors. The slat does have a small thickness of approximately twice the thickness of the slat material in this location at its upper side, but the slat has a comparatively small height there. It still lies below the longitudinal axis of the lamp. The slat is irradiated by the lamp there and can still cause bright spots within the cut-off angle through reflection on the reflectors.

It is a disadvantage in a luminaire having only one light emission window, such as the luminaire of the cited DE-A-32 15 026 and of the cited US-A-4,888,668, that the lateral edges of the inner surface approach one another, because this is a result of the presence of flat side surfaces approaching one another in upward direction. These give rise to additional reflections in the luminaire and thus to additional light losses.

It is an important disadvantage, however, that slats may be comparatively voluminous owing to the rising inner surface and accordingly require comparatively much material, for example synthetic resin or metal, for example metal plating, if the slats extend up to a comparatively large distance away from the light emission window. This may be the case, for example, owing to a comparatively great dimension of the light emission window transverse to the longitudinal axis, or owing to the shape of the reflectors such that these are still comparatively far removed from one another comparatively high in the housing, or owing to a comparatively great angle at which the inner surface extends in a direction away from plane P.

It is known from NL-A-94 02 049 to give the inner surface a stepped shape, so that the slats in lateral view have an inner surface with a sawtooth contour. This renders the slats less voluminous. The slats, however, have a complicated shape which is difficult to manufacture.

SUMMARY OF THE INVENTION

It is an object of the invention to provide a luminaire which has slats of comparatively small volume even though they are to extend to comparatively far from the light emission window, which slats are nevertheless comparatively easy to manufacture and avoid bright spots in the cut-off angle.

According to the invention, the inner surface of each slat lies substantially in a plane Q parallel to plane P in an end zone adjacent the reflectors, while the longitudinal axis of the lamp lies in a region which extends from plane Q to plane P.

The invention is based on the following recognitions:

that the end zones of the inner surface of each slat may be mirrors which image the upper portion of the lamp, i.e. the portion facing away from the light emission window; and that the image of the upper portion of the lamp may coincide with the lower portion of the lamp, i.e. the portion facing the light emission window, and may overlap said lower portion more than entirely or only partly; and that no bright spots are visible within the cut-off angle if the image coincides with the lower portion of the lamp, and also if the image overlaps this lower portion only partly. These recognitions will be explained with reference to the drawings.

Luminaries may have widely differing cut-off angles in dependence on the application in which a luminaire is used. The cut-off angle of a luminaire usually lies between approximately 20 and approximately 50°. There are standards specifying how much light is allowed to fall within the cut-off angle, for example owing to multiple reflections: for example, as viewed from the cut-off angle the luminaire is allowed to have an overall luminance of at most 200 cd/$M^2$, but comparatively bright spots must not be brighter than 500 cd/$m^2$.

The slats together define the screening in the direction of the longitudinal axis of the lamp and the screening in directions around the former. The reflectors determine the screening transverse to the longitudinal axis and the screening in directions around this. Given a certain location of the lamp in the luminaire, the reflector determines the angle $\alpha$ to plane P (see FIG. 2) at which it has just become impossible to observe the lamp: if the lower side of the lamp is not visible, then the upper side is not visible either. Light cannot leave the luminaire at a smaller angle without previous reflection. This angle $\alpha$ is given by the line tangent to the lower side of the lamp and passing through the edge of the reflector. The reflector at this angle forms a mechanical screening for the lamp.

It may also have been opted for in the design of the luminaire that no light can leave the luminaire at an angle smaller than a also after reflection against the reflectors. It may alternatively have been opted for that the reflectors project light to the exterior at a smaller angle to plane P. In that case the cut-off angle $\beta$ of the luminaire in the direction transverse to the longitudinal axis of the lamp and in directions around the former is smaller than the angle at which the reflector hides the lamp from view.

As is apparent from FIG. 4, the position of the lower side of the lamp 3 is important for the cut-off angle $\beta$, as it is for the mechanical screening. If the lower side of the lamp does not cause undesirable light in a light beam passing in between through two slats 10, after reflection by the reflector 5, then the upper side will not do this either: light beam a from the upper side of the lamp will be thrown directly to the exterior by the reflector at a steeper angle than light beam b from the lower side.

In contrast to the above, however, the risk of the upper side of the lamp radiating light within the cut-off angle $\beta$, through reflection against the inner surface 11 of a slat 10 and a subsequent reflection against a reflector, is greater than of the lower side of the lamp doing this. Light beam c from the upper side of the lamp, after reflection by the inner surface and subsequently by the reflector, will leave the luminaire at a much smaller angle than beam a and also beam b would leave via reflection by the same location of the reflector.

According to the recognitions on which the invention is based, the upper side of the lamp can be mirrored in the end zone without causing spots within the cut-off angle, provided the virtual image of the upper side does not fall substantially below the lower side of the lamp. The light reflected in the end zone then seems to originate from the lower side of the lamp, or from a location higher than the lower side of the lamp, and thus does not give rise to bright spots within the cut-off angle $\beta$. In fact, light can be radiated directly to a corresponding location of the reflector between the slats. The reflector shape is so designed that it can handle light coming from this direction, so that the reflector will reflect this light in a desired direction. In FIG. 4A, the end zone 14 of the slat 10 causes a virtual image 3' of the lamp which lies lower than the lamp itself. Light beam c is a continuation of the virtual light beam c' after reflection by the end zone. If the reflector is designed only to reflect beam b at an acceptable angle, beam c' will be reflected at an unacceptable angle.

It depends on the reproducibility with which the lamp can be positioned relative to the slats and the reflector whether the luminaire is designed such that the plane Q passes through the longitudinal axis of the lamp or lies above this axis.

The concave reflectors and the slats may be made of metal or of synthetic resin with a reflecting surface. They may have a mirror reflection or may have a matt or semi-glossy finish.

The concave reflectors may have a connecting reflector between them in the housing, extending above the lamp. Alternatively, they may be integral with such a connecting reflector. Usually, but not necessarily, the reflectors will have been assembled together with the slats into a unit.

The slats may each have a straight boundary in the light emission window, or alternatively a different, for example concave boundary. The latter is favorable for obtaining a more uniform cut-off angle in the longitudinal direction of the lamp and in directions around the former.

The inner surface of each slat may be, for example, straight in the central zone, parallel to the light emission window, or concave, for example cylindrically curved. An inner surface which is straight in its central zone may merge into the flanks, which widen at an angle away from plane P, for example with a bend having a comparatively small radius of curvature, for example a few mm up to a few tens of mm, for example 25 mm. Whereas the inner surface centrally in the central zone requires no slope for reflecting incident light towards a location high in the luminaire, a small angle increasing as the distance to the center increases is already sufficient for this laterally of the center. The flanks may thus lie farther removed from the central zone, which also leads to a smaller volume and thus to a smaller material requirement for the slats.

The slats are not only V-shaped in cross-section but also concavely curved. They have the object inter alia to intercept light which would be radiated to the exterior in the longitudinal direction of the lamp at a small angle to plane P and to reflect this light at a greater angle to the plane P as a result of their V-shape. The concave shape deflects the light still further upon reflection, so that it is radiated at an even greater angle than if the slats were V-shaped only. Additional reflections on the opposite slat are avoided thereby. The concave shape of each slat may continue up to the inner surface, but this is not necessary. Each slat may have a folding line in its surface at a distance from plane P close to the lamp, from which folding line the slat extends in a straight line towards the inner surface. The surfaces of the slats may approach one another in the direction towards the inner surface between the folding line and the inner surface. This may be desirable if a light window for creating indirect lighting is present opposite the light emission window. The surfaces of the slats, however, may alternatively extend mutually parallel between the folding line and the inner surface. This may be favorable for giving the slats a constant thickness, i.e. dimension in the longitudinal direction of the lamp, at their inner surfaces over their entire length. This thickness may then correspond to the thickness of a conventional slat with an inner surface which lies in a flat plane. A small thickness also reduces the volume, and thus saves material and intercepts little light.

The lamp may be, for example, a fluorescent lamp, for example having a linear tubular lamp vessel. Alternatively, the lamp may have several, for example two linear parallel tubular portions. These portions may lie in a plane parallel to plane P, or in a plane transverse thereto. The luminaire may alternatively have, for example, two linear tubular lamps in an analogous arrangement.

The luminaire may be designed for being suspended from or mounted against a ceiling, or for being recessed in a false ceiling.

DETAILED DESCRIPTION OF THE PREFERRED EMBODIMENTS

Figure 1:
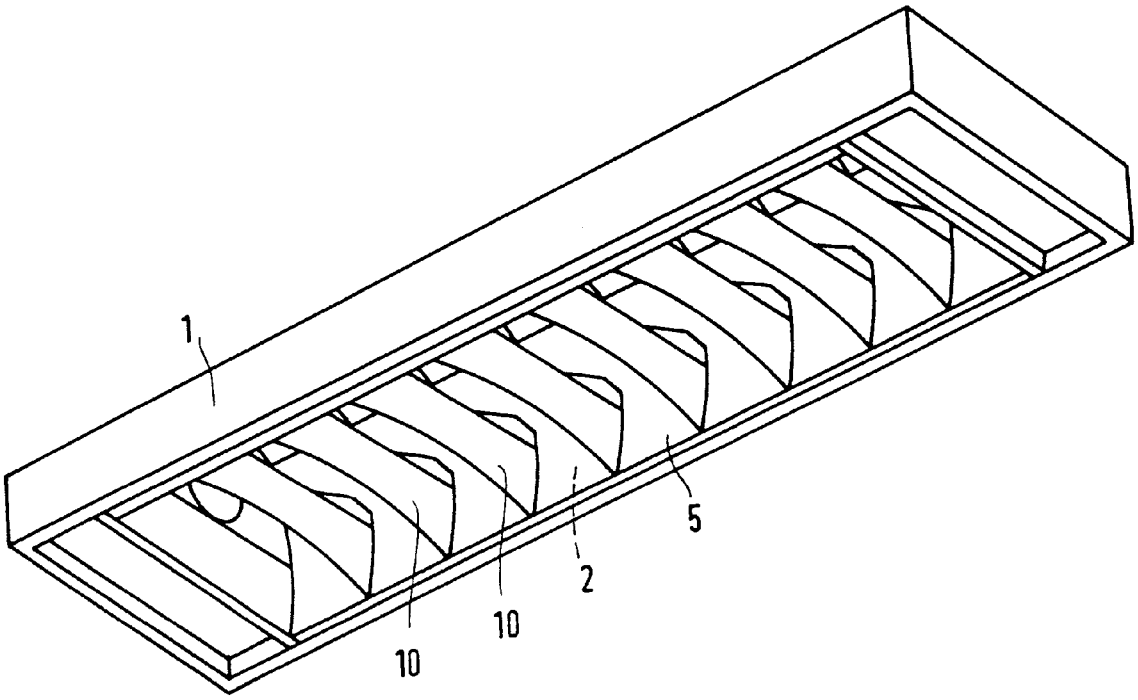
FIG. 1 shows the luminaire in perspective view.
Figure 2:
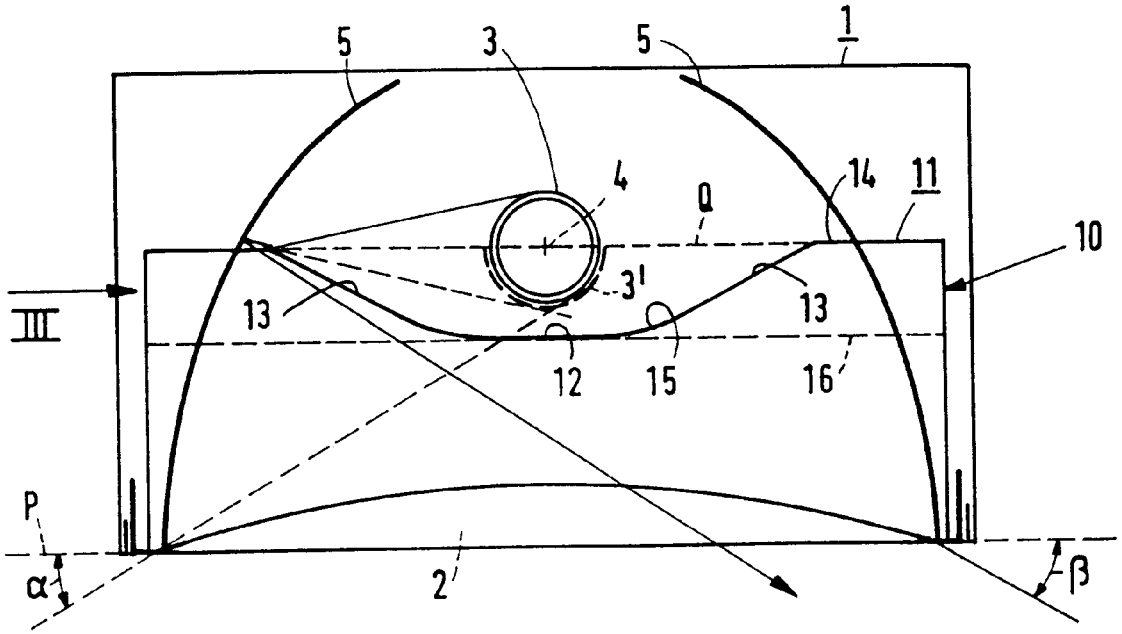
FIG. 2 is a cross-section of the luminaire of FIG. 1.

In FIGS. 1 and 2, the luminaire has a housing 1 with a light emission window 2 in a plane P. A tubular electric lamp 3, a fluorescent lamp in the Figures, with a ; longitudinal axis 4 is mounted in the housing 1, as are concave reflectors 5 laterally of the lamp 3 and extending into the light emission window 2. The reflectors 5 are curved, and the lamp 3 is positioned between the reflectors 5 so as to project light radiated transversely to the longitudinal axis 4 through the light emission window 2 to the exterior at an angle to plane P greater than a cut-off angle β. Several slats 10, which are V-shaped in cross-section and concavely curved, extend transversely to the reflectors 5 and into the light emission window 2. They each have between the reflectors 5 a reflecting inner surface 1I1 which faces the lamp 3 and which has flanks 13 which extend from a central zone 12 situated centrally between the reflectors 5 at an angle away from plane P. The slats 10 have concave boundaries at the light emission window 2. The slats 10 form a unit together with the reflectors 5 in the Figures, made from metal with a semi-bright finish.

The inner surface 11 of each slat 10 lies substantially in a plane Q parallel to plane P in an end zone 14 adjacent the reflectors 5, while the longitudinal axis 4 of the lamp 3 lies in a region extending from plane Q to plane P.

The inner surface 11 of each slat 10 merges from the central zone 12 via a curved portion 15, with a radius of curvature of 25 mm in the Figure, into the flanks 13.

Figure 3:
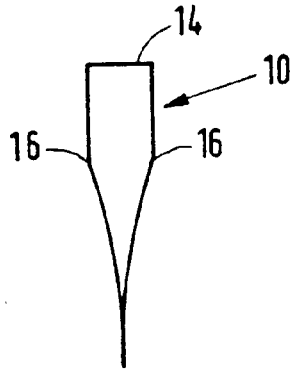
FIG. 3 is an elevation of a slat viewed along the line III in FIG. 2.
Figure 4A:
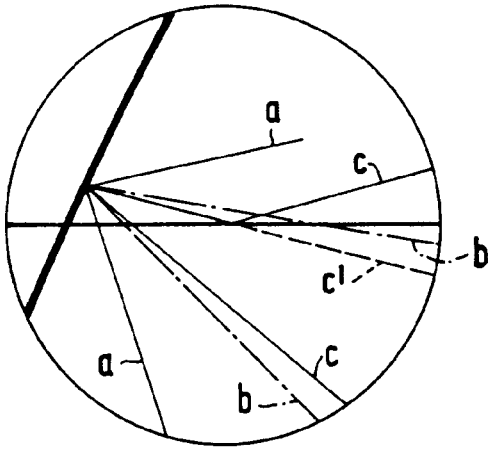
FIGS 4A is an enlarged view of the end zone circled in FIG. 4
Figure 4:
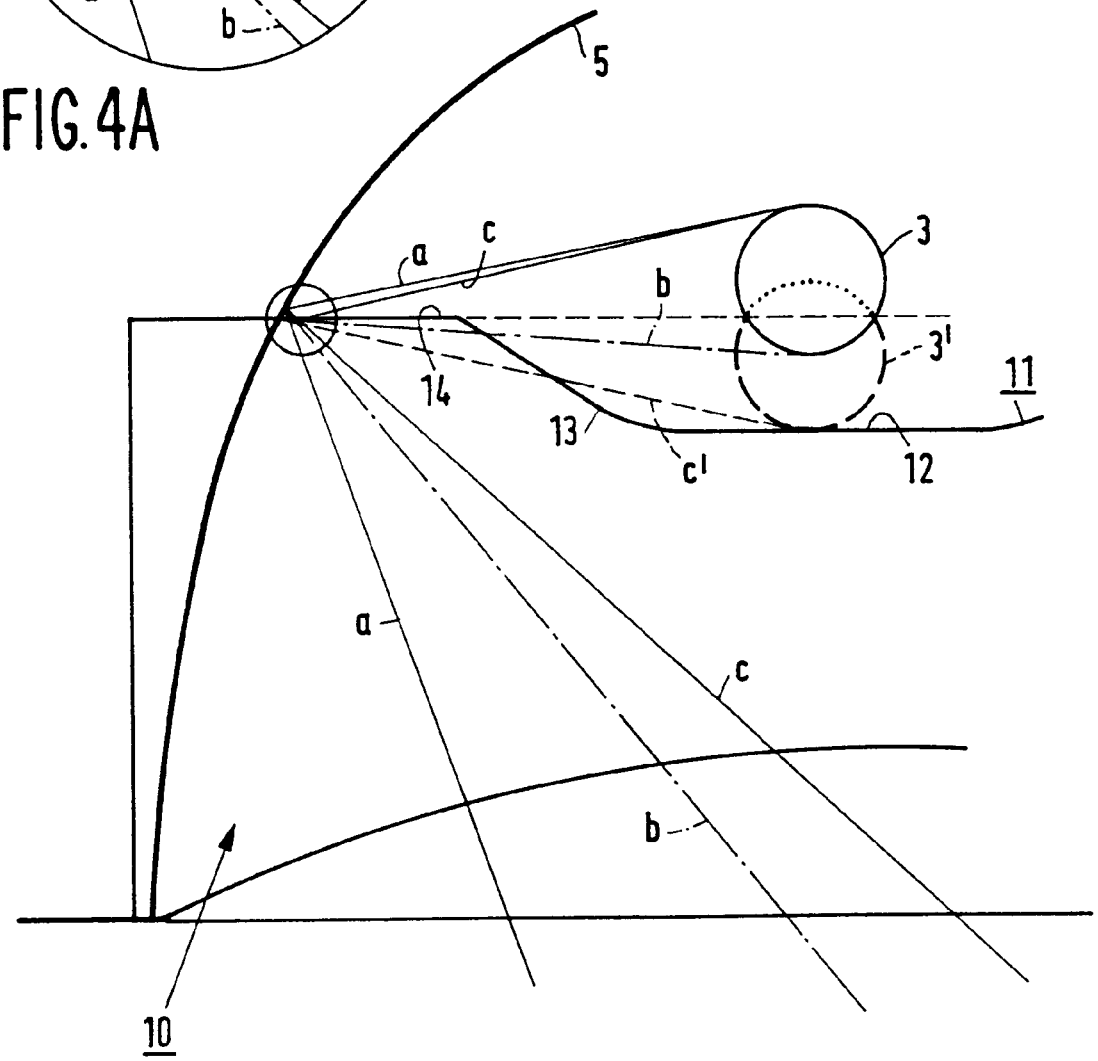
FIG. 4 diagrammatically depicts the light beams in a luminaire not according to the invention.

Each slat 10 has, see also FIG. 3, a folding line 16 in its surface at a distance from plane P, from which line it extends along a straight line towards the inner surface 11, the surfaces running mutually parallel from the folding lines 16 to the inner surface 11

It is an advantage of the slats of the luminaire according to the invention that they are capable of making a closed connection with reflectors 5 by means of the inner surface 11 with its end zones 14 which are substantially parallel to plane P, independently of whether the reflectors are comparatively strongly vertical or comparatively strongly sloping, and accordingly the slat 10 projects comparatively little or comparatively much through the reflectors. This is in contrast to slats whose flanks continue up to the reflectors 5. In that case each reflector shape requires slats of a specific shape for obtaining a closed connection.

We claim:

1. A luminaire comprising a housing with a light emission window in a plane (P), a pair of concave reflectors in the housing, said reflectors extending toward said window, a plurality of slats extending transversely to said concave reflectors, each said slat having a V-shaped cross-section, and an inner surface facing away from said window, said inner surface comprising a central zone, a pair of flanks extending from the central zone at an angle away from the plane (P), and a pair of end zones extending from said flanks to respective said reflectors, said end zones lying in a plane (Q) parallel to the plane (P), and a tubular electric lamp having a longitudinal axis lying between the plane (Q) and the plane (P), said lamp being positioned between the reflectors so as to throw light transversely to the longitudinal axis through the light emission window at an angle to said plane (P) which is greater than a cut-off angle.

2. A luminaire as in claim 1 wherein said inner surface comprises a pair of curved portions merging from said central zone into respective flanks.

3. A luminaire as in claim 1 wherein each slat further comprises a pair of parallel fold lines defining the top of said V-shaped cross section, and a pair of flat surfaces extending from said fold lines to said inner surface.

4. A luminaire as in claim 3 wherein said surfaces extend from said fold lines to said inner surface in parallel.

5. A luminaire as in claim 1 wherein said slats including said end zones of said inner surface extend through said reflectors.

* * * * *